US011398690B2

(12) United States Patent
Chiang

(10) Patent No.: US 11,398,690 B2
(45) Date of Patent: Jul. 26, 2022

(54) WIRELESS TRANSMISSION DEVICE

(71) Applicants: BENQ CORPORATION, Taipei (TW); BenQ Intelligent Technology (Shanghai) Co., Ltd, Shanghai (CN)

(72) Inventor: Chin-Fu Chiang, New Taipei (TW)

(73) Assignees: BENQ CORPORATION, Taipei (TW); BenQ Intelligent Technology (Shanghai) Co., Ltd, Shanghai (CN)

( * ) Notice: Subject to any disclaimer, the term of this patent is extended or adjusted under 35 U.S.C. 154(b) by 0 days.

(21) Appl. No.: 17/124,591

(22) Filed: Dec. 17, 2020

(65) Prior Publication Data

US 2021/0194160 A1 Jun. 24, 2021

(30) Foreign Application Priority Data

Dec. 20, 2019 (CN) ..... 201911321436.X

(51) Int. Cl.
*H01R 13/639* (2006.01)
*H01R 12/70* (2011.01)

(52) U.S. Cl.
CPC ..... *H01R 12/7023* (2013.01); *H01R 12/7076* (2013.01); *H01R 13/639* (2013.01)

(58) Field of Classification Search
CPC ..... H01R 12/7023; H01R 13/639; H01R 12/7076; H01R 13/621; H01R 13/6395
See application file for complete search history.

(56) References Cited

U.S. PATENT DOCUMENTS 4,302,066 A * 11/1981 Newman ..... H01R 13/6395 439/347
4,575,595 A * 3/1986 Gill ..... H01H 9/20 200/50.3
4,710,136 A * 12/1987 Suzuki ..... H05K 5/0204 439/297
5,011,426 A * 4/1991 Colleran ..... B60G 17/0408 439/347
5,277,611 A * 1/1994 Berek ..... H01R 12/7005 439/325
5,419,717 A * 5/1995 Abendschein ..... G02B 6/3897 385/139
5,639,255 A * 6/1997 Muzslay ..... H01R 13/521 439/347

(Continued)

FOREIGN PATENT DOCUMENTS

CN 208503231 U 2/2019
TW M285820 U 1/2006

(Continued)

*Primary Examiner* — Neil Abrams

(57) ABSTRACT

A wireless transmission device is provided. The wireless transmission device includes a body, a connection cable electrically connected to the body, and at least one fixing member. The body includes a slot and a first fixing base. The connection cable includes a plug and a second fixing base. The plug matches the slot, and the second fixing base and the first fixing base are opposite to each other in a vertical manner. The at least one fixing member is inserted into the first fixing base and the second fixing base to fix the plug in the slot. The present invention increases the coupling stability between the body and the connection cable, stabilizes signal transmission, reduces maintenance cost, and provides an integrated appearance.

18 Claims, 6 Drawing Sheets

(56) References Cited

U.S. PATENT DOCUMENTS 6,146,180 A * 11/2000 Betker ..... H01R 13/6273 439/352
6,155,862 A * 12/2000 Chiu ..... H01R 13/6278 439/347
6,319,039 B1 * 11/2001 Chambly ..... H01R 13/5219 439/282
6,383,031 B1 * 5/2002 Law ..... H01R 9/0515 439/680
6,719,591 B1 * 4/2004 Chang ..... H01R 27/02 439/638
6,746,284 B1 * 6/2004 Spink, Jr. ..... H01R 13/432 439/651
6,943,527 B2 * 9/2005 Liu ..... G06F 1/1616 320/107
6,964,586 B2 * 11/2005 Siddiqui ..... H01R 24/58 439/669
7,128,595 B2 * 10/2006 Boutros ..... H01R 13/6275 439/358
7,578,691 B2 * 8/2009 Weksler ..... H01R 13/6278 439/347
7,591,673 B2 * 9/2009 Chan ..... G06F 1/266 439/502
7,986,141 B2 * 7/2011 Feld ..... H01R 13/635 324/318
8,092,241 B2 * 1/2012 Chang ..... H01R 13/70 439/305
8,177,586 B2 * 5/2012 Daschner ..... H01R 13/645 439/680
8,267,723 B2 * 9/2012 Hering ..... H01R 13/73 439/924.1
8,328,562 B1 * 12/2012 Rassoolkhani ..... H01R 11/18 320/104
8,371,870 B2 * 2/2013 Ma ..... H01R 13/6278 439/347
8,876,539 B2 * 11/2014 Gette ..... H01R 13/453 439/137
8,900,006 B2 * 12/2014 Gaul ..... B60L 53/65 439/489
8,951,060 B2 * 2/2015 Meyer-Ebeling ..... B60L 53/16 439/347
9,882,319 B2 * 1/2018 Kageta ..... H01R 13/6691
10,374,361 B1 * 8/2019 Lien ..... H01R 24/68
2003/0133014 A1 * 7/2003 Mendoza ..... B60R 1/00 348/148
2008/0268680 A1 * 10/2008 Ho ..... H01R 13/645 439/140
2010/0228405 A1 * 9/2010 Morgal ..... B60L 50/20 701/1
2011/0067225 A1 * 3/2011 Bassaco ..... F16D 25/08 285/82
2021/0194160 A1 * 6/2021 Chiang ..... H01R 12/7023

FOREIGN PATENT DOCUMENTS

TW M347723 U 12/2008
TW I543467 B 7/2016
TW M527634 U 8/2016

* cited by examiner

WIRELESS TRANSMISSION DEVICE

This application claims the benefit of People's Republic of China application Serial No. 201911321436.X, filed Dec. 20, 2019, the subject matter of which is incorporated herein by reference.

BACKGROUND OF THE INVENTION

Field of the Invention

The invention relates in general to a transmission device, and more particularly to a wireless transmission device.

Description of the Related Art

Generally speaking, a connector is used by way of plugging and unplugging. However, when the connector is repeatedly plugged and unplugged over a long period of time, the connection cable may be bent or deflected, the connection point may become loose, and the quality of signal transmission may deteriorate.

SUMMARY OF THE INVENTION

The invention is directed to a wireless transmission device capable of securely fixing the connection cable on the body, not only complying with the integrated design and fixing an additional connection cable but further advantageously providing an integrated appearance, stabilizing signal transmission and reducing maintenance cost.

According to a first aspect of the present invention, a wireless transmission device is provided. The wireless transmission device includes a body, a connection cable electrically connected to the body, and at least one fixing member. The body includes a slot and a first fixing base. The connection cable includes a plug and a second fixing base. The plug matches the slot, and the second fixing base and the first fixing base are opposite to each other in a vertical manner. The at least one fixing member is inserted into the first fixing base and the second fixing base to fix the plug in the slot.

Through the design that the shape of the plug matches that of the slot of the body, the second fixing base of the plug is fixed by the fixing member, such that the coupling stability between the body and the connection cable is increased, the signal transmission is stabilized, the maintenance cost is reduced, and an integrated appearance is provided.

The above and other aspects of the invention will become better understood with regard to the following detailed description of the preferred but non-limiting embodiment(s). The following description is made with reference to the accompanying drawings.

DETAILED DESCRIPTION OF THE INVENTION

Detailed descriptions of the invention are disclosed below with a number of embodiments. However, the disclosed embodiments are for explanatory and exemplary purposes only, not for limiting the scope of protection of the invention. Similar/identical designations are used to indicate similar/identical elements.

Figure 1:
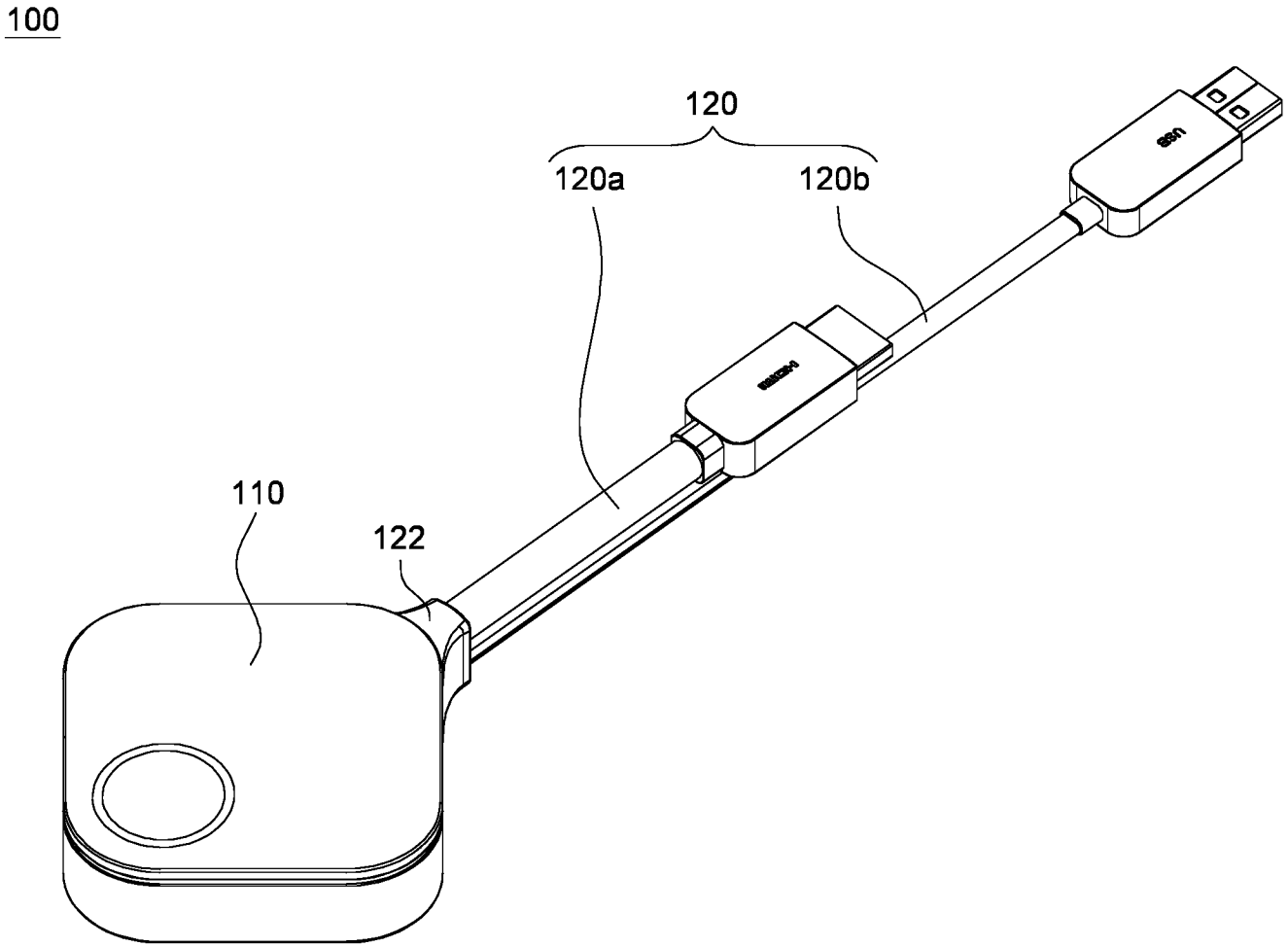
FIG. 1 is a schematic 3D diagram of a wireless transmission device according to an embodiment of the present invention.
Figure 2:
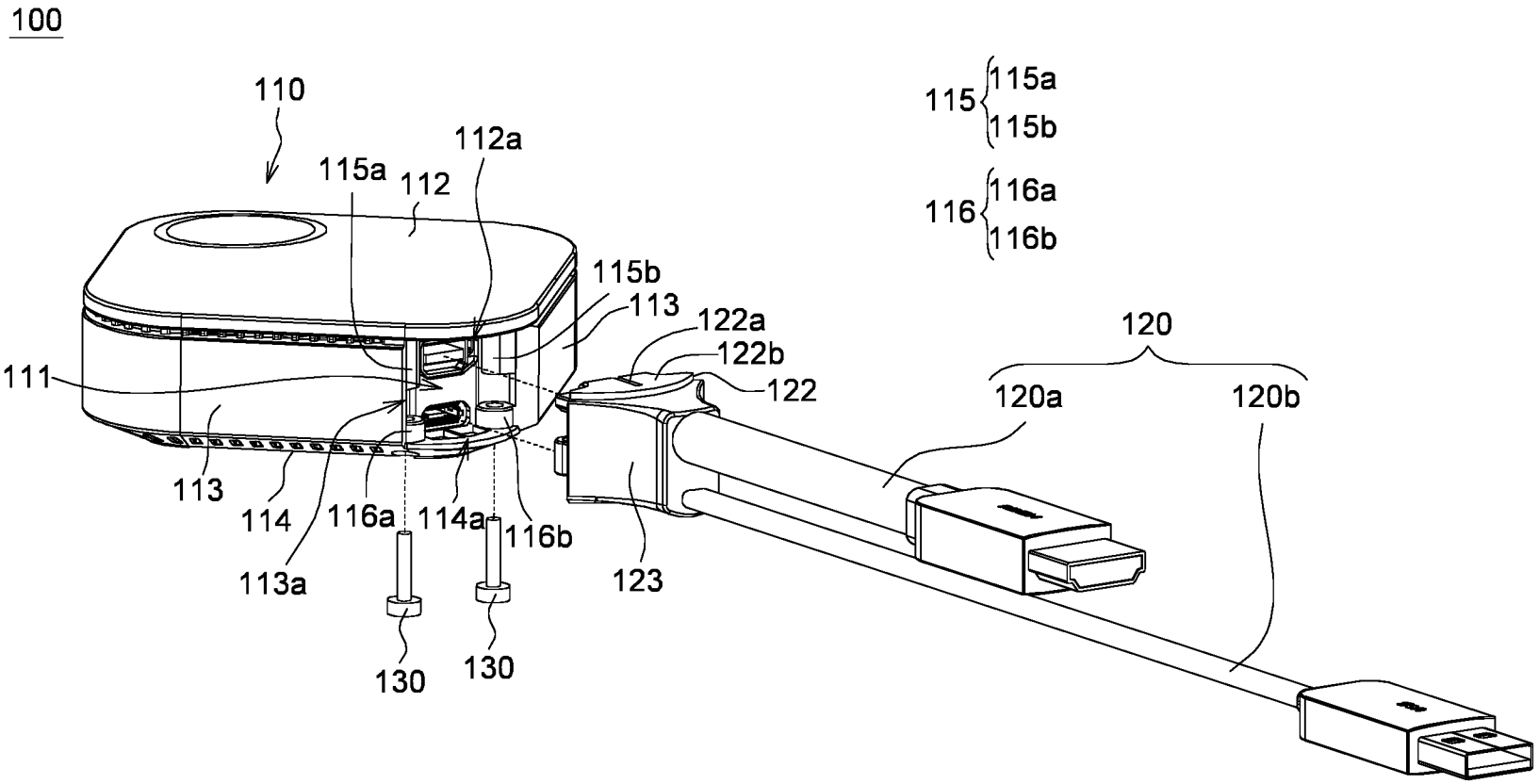
FIG. 2 is an explosion diagram of a wireless transmission device according to an embodiment of the present invention.
Figure 3:
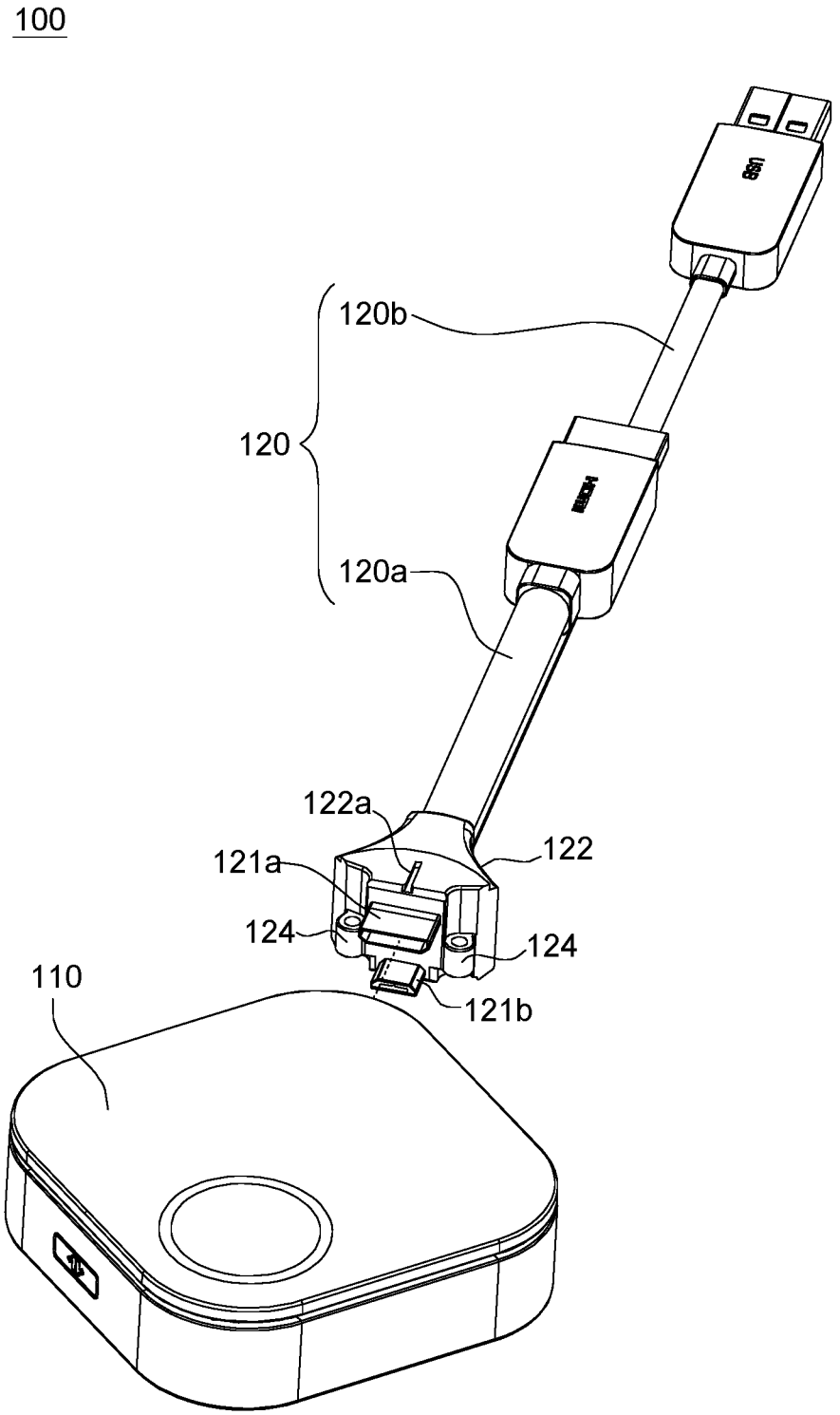
FIG. 3 is an explosion diagram of the wireless transmission device of FIG. 2 viewed from another view angle.

FIG. 1 is a schematic 3D diagram of a wireless transmission device 100 according to an embodiment of the present invention. FIG. 2, FIG. 3, FIG. 4 and FIG. 5 are respectively explosion diagrams of the wireless transmission device 100 viewed from different view angles. FIG. 6 is an interior perspective diagram of a wireless transmission device 100 according to an embodiment of the present invention.

Refer to FIG. 1 to FIG. 6. The wireless transmission device 100 includes a body 110, a connection cable 120 and at least one fixing member 130 (such as two). The body 110 includes a slot 111 (that is, female connector) and a set of first fixing bases 115 and 116. The connection cable 120, electrically connected to the body 110, includes a plug 122 (that is, male connector) and a set of second fixing bases 124, wherein the shape of the plug 122 matches the shape of the slot 111, and the set of second fixing bases 124 and the set of first fixing bases 115 and 116 are opposite to each other in a vertical manner. At least one fixing member 130 (for example two), is inserted into the set of first fixing bases 115 and 116 and the set of second fixing bases 124 to fix the plug 122 in the slot 111.

In an embodiment, the body 110 can be a transmitter module configured to transmit a video signal to a wireless projection device. That is, the transmitter module is configured to emit the video signal to the reception end of a wireless projection device or other wireless electronic device, and then the video signal is played by a projector or a screen. Or, the body 110 can be a receiver module configured to receive a video signal and then transmit the video signal to a wireless projection device or other wireless electronic device. The said arrangement is not subjected to specific restrictions in the present invention.

In an embodiment, the wireless transmission device 100 is electrically connected to a desktop electronic device (such as computer) or a portable electronic device (such as mobile phone) through the connection cable 120. The desktop electronic device and the portable electronic device can be provided with a video output terminal and a power output terminal. The connection cable 120 can be realized by an HDMI (High Definition Multimedia Interface) connection cable 120*a* or a USB connection cable 120*b*. The HDMI connection cable 120*a* is configured to connect the video output terminal, and the USB connection cable 120*b* is configured to connect the power output terminal or an external power source (such as the mains). Exemplarily but not restrictively, the connection cable 120 can also be realized by a USB type C connection cable configured to connect the video output terminal and the power output terminal.

That is, the connection cable 120 has a quantity of two, and the two connection cables respectively are connected to the plug 122, which includes a power connection terminal 121*b* (male connector) and a video transmission terminal 121*a* (male connector). The power connection terminal 121*b*

Figure 4:
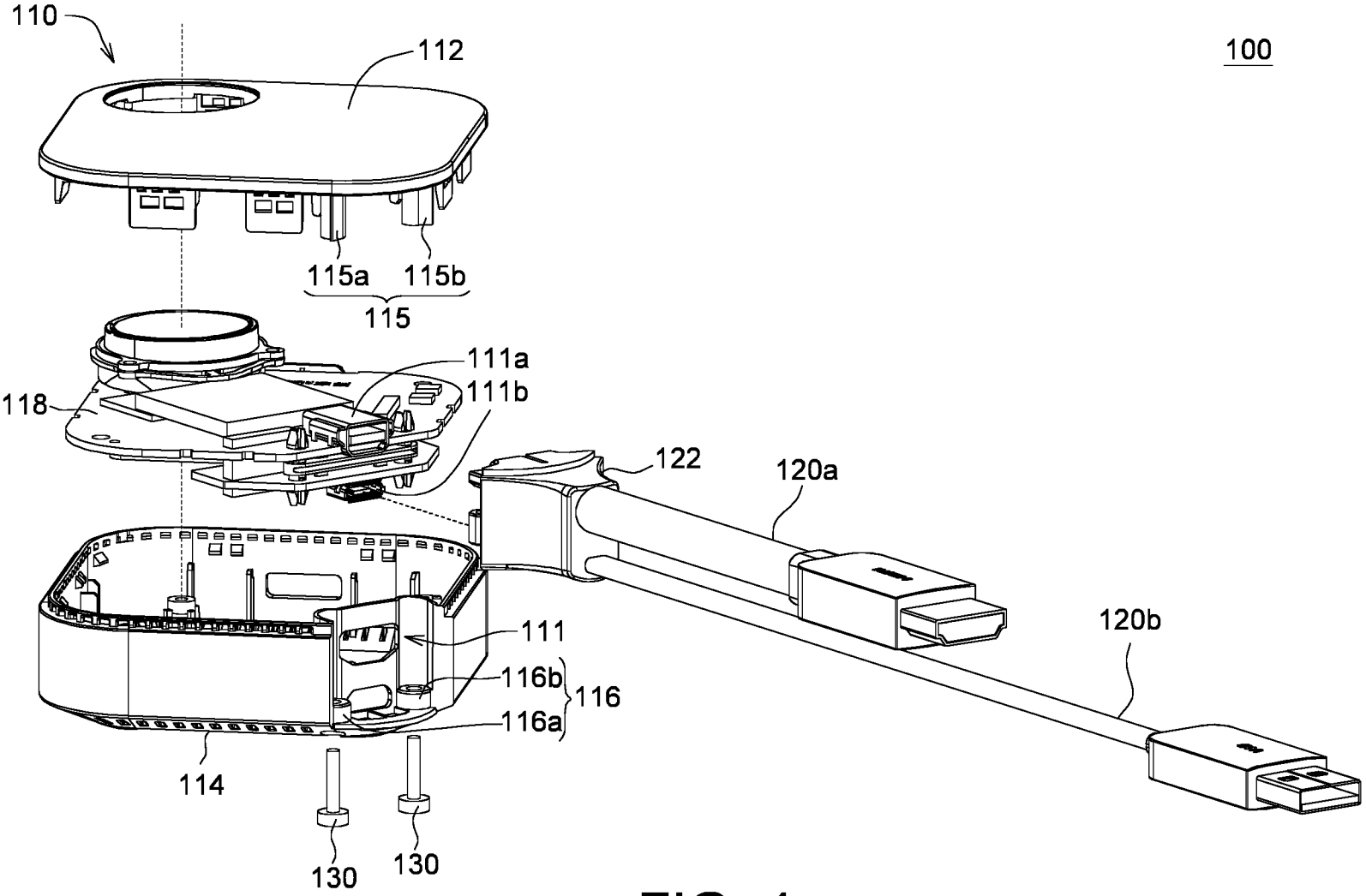
FIG. 4 is an explosion diagram of wireless transmission device according to an embodiment of the present invention.

(male connector) and the video transmission terminal 121*a* correspondingly connect a power connection terminal 111*b* (female connector) and a video transmission terminal 111*a* (female connector) of the body 110. Refer to FIG. 4. The power connection terminal 111*b* (female connector) and the video transmission terminal 111*a* (female connector) are disposed on the circuit board 118. Or, the connection cable 120 has a quantity of one, and the plug 122 includes a USB type C transmission terminal (male connector) correspondingly connecting the USB type C transmission terminal (female connector) of the body 110 and is disposed on the circuit board 118. When the male/female connector between the connection cable 120 and the body 110 becomes loose or has poor contact, the transmission stability of video signal will be affected. Therefore, in the present invention, the plug 122 is firmly fixed in the slot 111 through a more stable structure.

In an embodiment, the shape of the plug 122 is a triangle, a quadrilateral, a trapezoid or an arc, and the shape of the slot 111 matches any of the above shapes, such that when the plug 122 is inserted into the slot 111, the plug 122 and the slot 111 are tightly engaged (that is, the male connector and the female connector are tightly engaged). The shape of the body 110 is such as a quadrilateral or an arc, and the lateral side 113 of the body 110 and the lateral side 123 of the plug 122 are immediately connected to comply with the integrated design.

In an embodiment, the fixing member 130 has a quantity of two, and the two fixing members respectively are inserted into the body 110 via its bottom. The fixing member 130 may be, for example, a screw or other locking member. The bottom of the body 110 is correspondingly provided with two openings (referring to FIG. 5). The fixing member 130, once installed, is hidden at the bottom of the body 110 and will not be exposed on the outer surface of the plug 122. Therefore, when the wireless transmission device 100 needs to be repaired or the connection cable 120 needs to be replaced, the user only needs to open the fixing member 130 and unplug the connection cable 120 without having to detach the upper cover 112 of the body 110, hence making the following maintenance more convenient and the maintenance cost lowered.

Moreover, the set of first fixing bases 115 and 116 and the set of second fixing bases 124 respectively have a quantity of two, and the two first fixing bases 115 and 116 and the two second fixing bases 124 respectively are disposed on two opposite sides of the slot 111 and the plug 122 (in a vertical direction). When the fixing members 130 are inserted into the body 110 via its bottom, the fixing members 130 are inserted into the two first fixing bases 115 and 116 and the two second fixing bases 124 respectively to fix the plug 122 in the slot 111 as indicated in FIG. 6.

Additionally, to firmly fix the plug 122 in the slot 111, the set of first fixing bases 115 and 116 disposed in the slot 111 of the body 110 and the set of second fixing bases 124 disposed in the plug 122 are opposite to each other in a vertical manner, and the set of second fixing bases 124 is clamped and positioned in a vertical direction, such that after the body 110 and the connection cable 120 are coupled together, the coupling stability can be increased and signal transmission can be stabilized. Or, the upper cover 112 and the lower cover 114 of the body 110 are protruded outwards to define a limiting space, wherein the upper surface and the lower surface of the plug 122 correspondingly contact the upper cover 112 and the lower cover 114 of the body 110, such that after the body 110 and the connection cable 120 are coupled together, the coupling stability can be increased and signal transmission can be stabilized.

Figure 5:
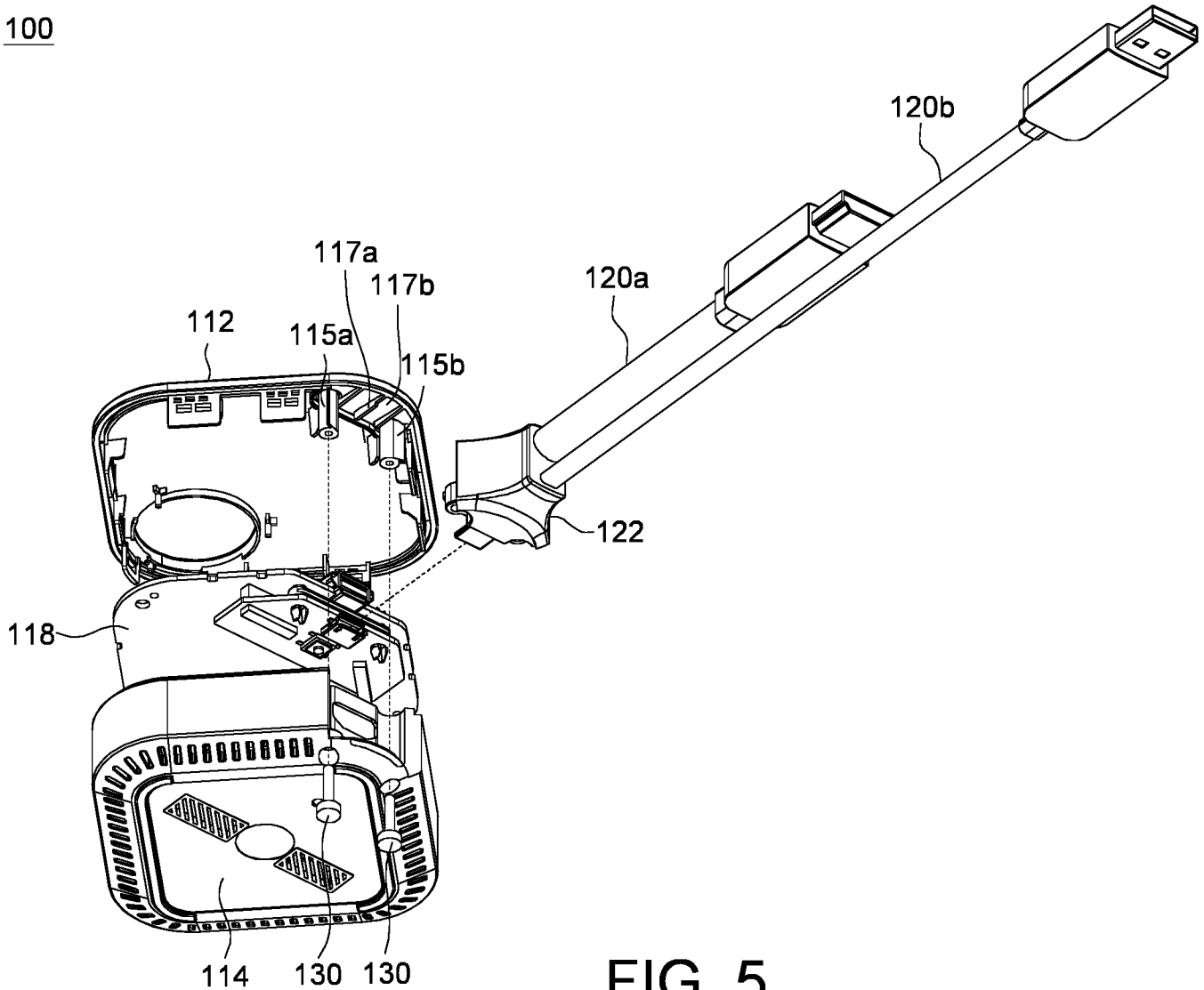
FIG. 5 is an explosion diagram of the wireless transmission device of FIG. 4 viewed from another view angle.
Figure 6:
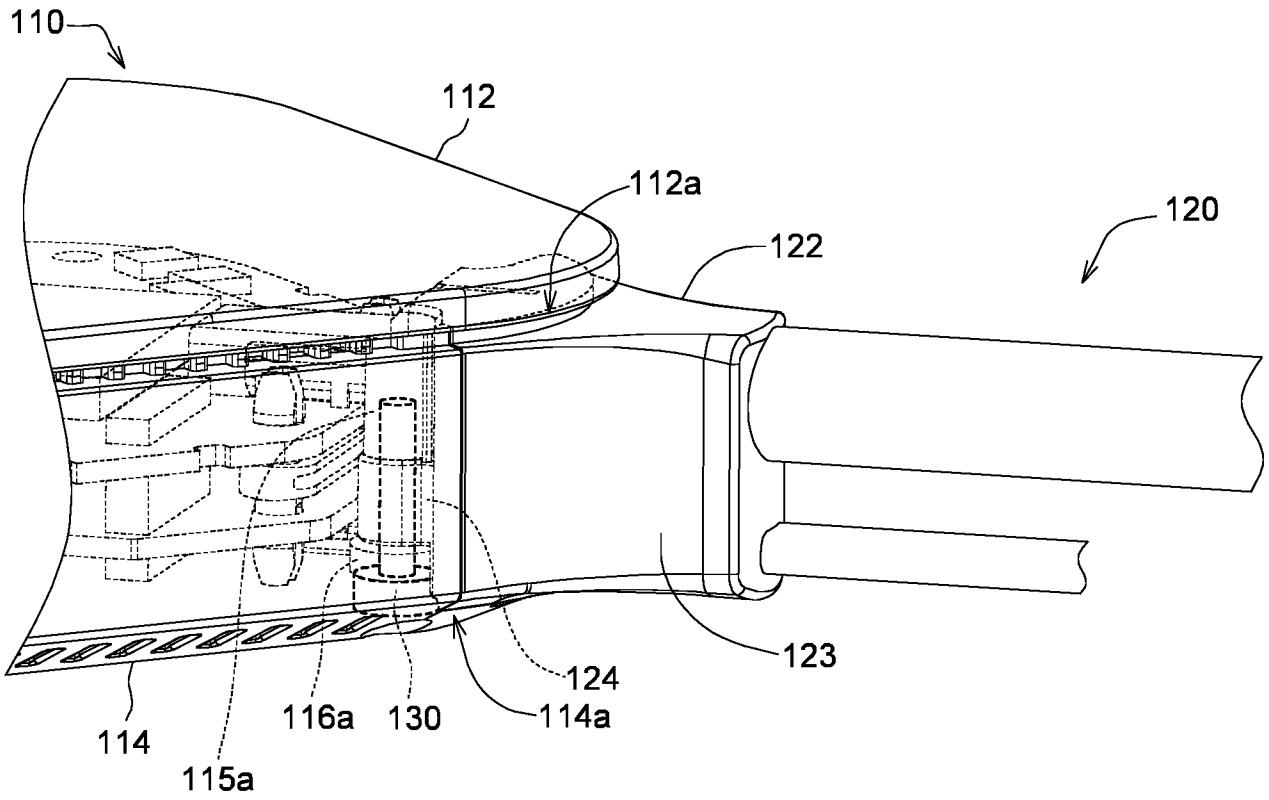
FIG. 6 is an interior perspective diagram of a wireless transmission device according to an embodiment of the present invention.

Refer to FIG. 4 and FIG. 5. The body 110 includes an upper cover 112, a lower cover 114 and two opposite sidewalls 113*a*, and the opening of the slot 111 is defined by the upper cover 112, the lower cover 114 and two opposite sidewalls 113*a* indented between the upper cover 112 and the lower cover 114. That is, the upper cover 112 and the lower cover 114 of the body 110 are protruded outwards to form a limiting space (that is, the slot 111). Therefore, when the plug 122 is inserted into the slot 111 between the upper cover 112 and the lower cover 114, the plug 122 is limited and positioned by two opposite inner lateral sides 112*a* and 114*a* of the upper cover 112 and the lower cover 114 to increase the coupling stability as indicated in FIG. 6.

In an embodiment, at least one of the inner lateral sides 112*a* and 114*a* of the upper cover 112 and the lower cover 114 is provided with a positioning slot 117*b* (referring to FIG. 5), and the upper surface or the lower surface of the plug 122 is correspondingly provided with a positioning block 122*b* (referring to FIG. 2) engaged with the positioning slot 117*b*. In another embodiment, at least one of the inner lateral sides 112*a* and 114*a* of the upper cover 112 and the lower cover 114 is provided with the positioning block 117*a* (referring to FIG. 5), and the upper surface or the lower surface of the plug 122 is correspondingly provided with the positioning slot 122*a* (referring to FIG. 2) engaged with the positioning block 117*a*. Thus, through the engagement between the positioning slot 122*a* (117*b*) and the positioning block 117*a* (122*b*), the plug 122 is firmly fixed in the slot 111 to increase the coupling stability.

Moreover, the upper cover 112 has a set of first slots 115*a* and 115*b*, the lower cover 114 has a set of second slots 116*a* and 116*b*, the first slots 115*a* and 115*b* and the corresponding second slots 116*a* and 116*b* are vertically aligned in a vertical direction, and a set of second fixing bases 124 is inserted into the space between the set of first slots 115*a* and 115*b* and the set of second slots 116*a* and 116*b*. The first slots 115*a* and 115*b* together with the second slots 116*a* and 116*b* form the set of first fixing bases 115 and 116 (referring to FIG. 2) opposite to the set of second fixing bases 124 in a vertical manner. That is, through the design that the second fixing base 124 is seamlessly inserted into the space between the set of first slots 115*a* and 115*b* and the set of second slots 116*a* and 116*b*, the set of second fixing bases 124 is positioned between the set of first slots 115*a* and 115*b* and the set of second slots 116*a* and 116*b* to increase the coupling stability.

The wireless transmission device disclosed in above embodiments of the present invention is capable of firmly fixing the connection cable on the body, not only complying with the integrated design and fixing an additional connection cable but further advantageously providing an integrated appearance, stabilizing signal transmission and reducing maintenance cost.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless transmission device, comprising:

a body, comprising a slot and two first fixing bases;

a connection cable electrically connected to the body, wherein the connection cable comprises a plug and two second fixing bases, the plug matches the slot, and the two second fixing bases and the two first fixing bases are opposite to each other in a vertical manner; and at least one fixing member inserted into one of the two first fixing bases and one of the two second fixing bases to fix the plug in the slot, wherein the connection cable has a quantity of two, and the two connection cables are connected to the plug and the plug comprises a power connection terminal and a video transmission terminal disposed in the vertical manner, wherein the two first fixing bases and the two second fixing bases respectively are located on two opposite sides of the slot and two opposite sides of the plug, and the plug is fastened by upper and lower sides of the body when the plug is inserted into the slot.

2. The wireless transmission device according to claim 1, wherein the fixing member has a quantity of two, and the two fixing members respectively are inserted into the body via a bottom of the body.

3. The wireless transmission device according to claim 1, wherein the body comprises an upper cover, a lower cover and two opposite sidewalls, and an opening of the slot is defined by the upper cover, the lower cover and the two opposite sidewalls indented between the upper cover and the lower cover.

4. The wireless transmission device according to claim 3, wherein the two first fixing bases comprise a set of first slots located on the upper cover and a set of second slots located on the lower cover, the set of first slots and the set of second slots are vertically aligned, and the two second fixing bases are respectively inserted into a space between the set of first slots and the set of second slots.

5. The wireless transmission device according to claim 4, wherein the two second fixing bases are respectively seamlessly inserted into the space between the set of first slots and the set of second slots, such that the two second fixing bases are positioned between the set of first slots and the set of second slots.

6. The wireless transmission device according to claim 3, wherein the plug is inserted into the slot between the upper cover and the lower cover, and the plug is limited and positioned by two opposite inner lateral sides of the upper cover and the lower cover.

7. The wireless transmission device according to claim 6, wherein at least one of the inner lateral sides of the upper cover and the lower cover is provided with a positioning slot, and an upper surface or a lower surface of the plug is correspondingly provided with a positioning block engaged with the positioning slot; or, at least one of the inner lateral sides of the upper cover and the lower cover is provided with the positioning block, and the upper surface or the lower surface of the plug is correspondingly provided with the positioning slot engaged with the positioning block.

8. The wireless transmission device according to claim 1, wherein the plug is shaped by a triangle, a quadrilateral, a trapezoid or an arc, and matches a shape of the slot.

9. A wireless transmission device, comprising:

a transmitter module, comprising a slot and two first fixing bases;

a connection cable electrically connected to the transmitter module, wherein the connection cable comprises a plug and two second fixing bases, the plug matches the slot, and the two second fixing bases and the two first fixing bases are opposite to each other in a vertical manner; and at least one fixing member inserted into one of the two first fixing bases and one of the two second fixing bases to fix the plug in the slot, wherein the connection cable has a quantity of two, and the two connection cables are connected to the plug and the plug comprises a power connection terminal and a video transmission terminal disposed in the vertical manner, wherein the two first fixing bases and the two second fixing bases respectively are located on two opposite sides of the slot and two opposite sides of the plug, and the plug is fastened by upper and lower sides of the body when the plug is inserted into the slot.

10. The wireless transmission device according to claim 9, wherein the transmitter module is configured to transmit a video signal to a wireless projection device.

11. The wireless transmission device according to claim 9, wherein the plug comprises a power connection terminal and a video transmission terminal.

12. The wireless transmission device according to claim 9, wherein the plug comprises a USB type C transmission terminal.

13. The wireless transmission device according to claim 9, wherein the two second fixing bases are respectively clamped and positioned by two of the two first fixing bases in a vertical direction.

14. The wireless transmission device according to claim 9, wherein an upper surface and a lower surface of the plug are correspondingly positioned when contacting an upper cover and a lower cover of the transmitter module.

15. The wireless transmission device according to claim 14, wherein the upper surface and the lower surface of the plug are provided with a positioning slot or a positioning block.

16. The wireless transmission device according to claim 14, wherein the upper cover and the lower cover of the transmitter module are provided with a positioning slot or a positioning block.

17. A wireless transmission device, comprising:

a receiver module, comprising a slot and two first fixing bases;

a connection cable electrically connected to the receiver module, wherein the connection cable comprises a plug and two second fixing bases, the plug matches the slot, and the two second fixing bases and the two first fixing bases are opposite to each other in a vertical manner; and at least one fixing member inserted into one of the two first fixing bases and one of the two second fixing bases to fix the plug in the slot, wherein the connection cable has a quantity of two, and the two connection cables are connected to the plug and the plug comprises a power connection terminal and a video transmission terminal disposed in the vertical manner, wherein the two first fixing bases and the two second fixing bases respectively are located on two opposite sides of the slot and two opposite sides of the plug, and the plug is fastened by upper and lower sides of the body when the plug is inserted into the slot.

18. The wireless transmission device according to claim 17, wherein the receiver module is configured to receive and transmit a video signal to a wireless projection device.

* * * * *